United States Patent [19]

Christensson

[11] 4,014,496

[45] Mar. 29, 1977

[54] CUP FORMED CONTAINER HAVING EDGE FLANGE

[75] Inventor: Od Wikar Christensson, Stockholm, Sweden

[73] Assignee: Asseltepac Aktiebolag, Järfalla, Sweden

[22] Filed: Nov. 24, 1975

[21] Appl. No.: 634,771

[30] Foreign Application Priority Data

Dec. 10, 1974 Sweden ..... 7415448

[52] U.S. Cl. ..... 229/31 R; 229/14 BA

[51] Int. Cl.[2] ..... B65D 5/24; B65D 5/40

[58] Field of Search .... 229/4.5 MF, 14 BL, 14 BA, 229/32, 30, 31

[56] References Cited

UNITED STATES PATENTS

| | | | |
|---|---|---|---|
| 597,731 | 1/1898 | Morrison | 229/31 R |
| 667,634 | 2/1901 | Schmidt | 229/24 |
| 917,962 | 4/1909 | Morrison | 229/31 R |
| 1,158,699 | 11/1915 | McCleery | 229/30 |
| 1,704,175 | 3/1929 | Coale | 229/3.5 MF X |
| 1,956;159 | 4/1934 | Reilly et al. | 229/14 BA UX |
| 1,965,138 | 7/1934 | Dunlap | 229/31 R X |
| 2,808,192 | 10/1957 | Raisin | 229/3.5 MF X |
| 3,035,735 | 5/1962 | Presnick | 229/30 X |
| 3,119,540 | 1/1964 | Schenk et al. | 229/2.5 |
| 3,489,331 | 1/1970 | Andersson | 229/31 R X |

*Primary Examiner*—Davis T. Moorhead
*Attorney, Agent, or Firm*—Larson, Taylor and Hinds

[57] ABSTRACT

A cup formed container made of a punched container blank of cardboard or the like has two opposite side pieces connected to the container bottom, and being wider than the bottom side with which they are connected. Opposite joint flaps are connected to the other two sides of the bottom. Each side piece has a central part which forms a complete container side and an outer side part on each end of the central part, these outer side parts each forming part of an adjacent side of the container, so that the outer side parts jointly form at least part of the intermediate container sides, with the joint flaps serving to complete the intermediate sides and keep the parts together. Around the complete upper edge of the container, including the corners, the container is formed with a downwardly directed narrow edge flange, which is made of and folded from the same material as the container sides and which forms an angle to the container sides, the flange being continuous and unbroken along the central side parts and the outer side parts of the side pieces, and hence around the corners of the container upper edge. The container may be lined. The construction stiffens the edge of the container, facilitates use of a reclosable lid, and removes the edge of the cardboard material from the contents of the container.

15 Claims, 13 Drawing Figures

CUP FORMED CONTAINER HAVING EDGE FLANGE

The present invention relates to a cup formed container for solid or semi-liquid products, e.g. foodstuffs like margarine and similar products, made from a plain punched container blank having a bottom, two side pieces which are coherent with the said bottom, and which are longer than the side of the bottom with which they hang together, and two joint flaps which are coherent with the bottom and the width of which are less than or the same as the side of the bottom with which they hang together, whereby the side pieces with a central part thereof form a complete side of the container and with an outer part thereof each on each side of the said central part form a part of the adjacent container side, so that the two outer parts of two side pieces, with or without the intermediate joint flap, form an intermediate container side of the container, and whereby the joint flaps serve to hold the said composite container side together. The container may be provided without any lining or with a thin and soft lining.

Containers are priorly known, which comprise an outer container bowl having a lining of a plastic material which covers the complete inside of the container and which may extend some distance down along the container side. In order to give a container of this kind sufficient stability for being handled and so that it may be provided with a recloseable lid it is necessary that the lining, which is usually made of a plastic material, has a relatively large bending strength of its own or that the part of the lining extending some distance down along the outside of the container is ended by a horizontally outwards directed flange.

Containers of this kind are relatively expensive to manufacture both depending on the relatively high cost for the lining material and also depending on the difficulties to form and attach the lining in the outer container. For cost reasons and depending on the general aim to reduce the amount of plastic material which is used there is therefore a need for a cup formed container which is made of a cardboard material and which may be lined with a thin and soft material like moisture protected paper, thin metal foil or similar, and which is stable enough to be handled without problems and to be provided with a recloseable lid.

When packing fatty and dampy products like margarine etc. it is further of importance that cut edges of the cardboard material be protected against contact with the fatty or dampy goods, since fat and damp easily penetrate into such cut edges thereby forming fat or damp precipitations or provide a splitting of the cardboard material. It may also in some cases happen that the packed goods if penetrating into the cardboard material dissolve out harmful constituents thereof, which is especially risky when packing foodstuffs like margarine. It is therefore of importance that the plainly cut upper edge of the container is protected against contact with the packed goods.

In some cases it has also shown that the previously known container having a plastic lining does not give sufficient tightness, and therefore there is a need for a container having a liner of a thin metal foil or similar. In combination with the said priorly known cup formed containers such a lining is however too soft and too easily formable to give the container the sufficient stability unless particular steps are taken or the thickness of the cardboard material is substantially increased, whereby the cost for the container increases.

According to the invention the above mentioned problems are solved in connection with a container of cardboard or similar stiff material in that the container is provided with a downwards slanting edge flange which forms a downwards diverging angle to the container side. The said downwards slanting edge flange provides a stiffening and a stabilizing of the upper edge of the container, it forms a spill edge, against which the packed material when necessary may be wiped off, behind which it is possible to tuck in the edge of a lining if any and which has as an effect that the cut edge of the cardboard material is located spaced from the upper edge of the container and is protected by the lining in case the container is formed with a lining.

The container may be formed with rectangular or square bottom and in this case the edge flange is directly contacting the container side at the vertical corners of the container, whereas the edge flange along the sides form the said angle to the container side depending on the tensioning outwards of the cardboard material. In a preferred embodiment of the invention the container is however formed with rounded corners, and in this embodiment the edge flange forms an angle to the container side around the entire upper edge of the container. The container may also be formed with vertical sides, but preferably the container is formed with upwardly diverging sides, whereby several containers may be stacked within each other, and in this case the edge flange is utilized to prevent the containers from keying on to each other.

Further characteristics of the invention will be evident from the following detailed description in which reference will be made to the accompanying drawings. In the drawings FIG. 1 shows a plain punched blank for a parallelepipedical container according to the invention, and FIG. 2 shows in a perspective view a ready container formed by the blank of FIG. 1. In a corresponding way FIG. 3 shows a plain punched blank having a lining for a conical container having rounded corners, and FIG. 4 shows a ready container formed by a blank of FIG. 3.

Figure 1:
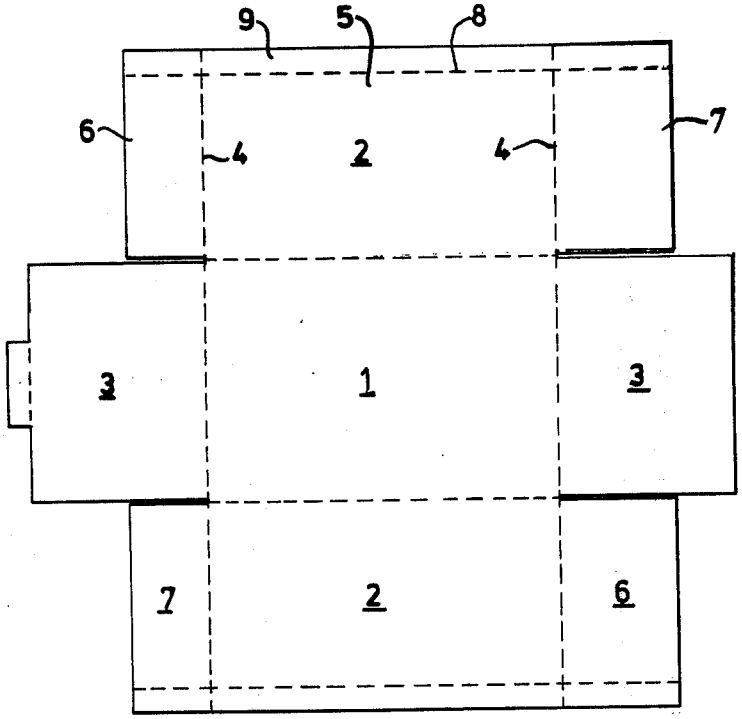

The container blank shown in FIG. 1 may be made of cardboard or similar stiff material, preferably a cardboard material which is made damp and fat protected in that the cardboard material is waxed, lacquered or treated in any other suitable way. The blank is formed with a bottom 1 of rectangular form, two opposite side pieces 2 which are coherent with the bottom and two opposite joint flaps 3, which are likewise coherent with the bottom. The side pieces 2 are longer than the side of the bottom with which they hang together, and each side piece is by means of creasing lines 4 divided into a central side part 5 and on each side thereof an outer side part 6 and 7 respectively.

The outer side parts 6 and 7 may have the same or different widths and they may be formed so as to provide the intermediate container side by engaging each other edge to edge, but they may also be formed so that the total width of the said two outer side parts is less than the adjacent container side, whereby the joint flap 3 join the two outer parts 6 and 7, or they may be formed so that the total width exceeds that of the adjacent side, whereby they overlap each other. In the last mentioned case the joint flap may be very narrow or may even be excluded.

The height of the joint flaps 3 is the same as or less than the height of the side pieces 2. By creasing lines 8 an edge strip 9 is delimited along the side edge of each side piece 2, which edge strip is intended to form a downwards directed edge flange in the ready container. The joint flaps 3 are mainly only intended to hold the outer side parts 6 and 7 together, and therefore the joint flaps 3 may be made narrow or tapering in the direction out from the bottom 1.

Figure 2:
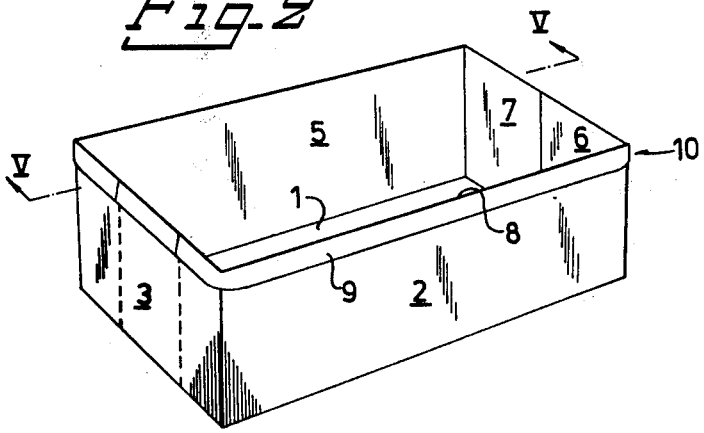

When erecting the container first the edge strips 9 are fold rearwardly along the creasing lines 8, whereupon the outer side parts 6 and 7 of the side pieces 2 are fold upwards at the same time as the central side part 5 is folded upwards. Finally also the joint flaps 3 are fold upwards and are attached to the outer side parts 6 and 7. If the joint flaps 3 are of substantially the same height as the side parts 5, 6 and 7 they are preferably put in under the downwards directed edge flange 9. Alternatively the joint flaps 3 may be provided at the inside of the container bowl. Preferably the outer side parts 6 and 7 are equal wide and the width thereof corresponds to half the adjacent side of the bottom 1, whereby the outer side parts 6 and 7 of the opposite side pieces 2 contact each other edge to edge as shown in FIG. 2. If found suitable they may alternatively be formed so as to overlap each other.

In a ready container the edge flange 9 tends to turn outwards, and this means that the flange only contacts the container bowl at the corners 10 thereof, whereas along the sides 5 and 6, 7 it is stretching outwards so as to extend slanting downwards from the upper edge of the container bowl and so as to form a downwards diverging angle to the container sides. By this the edge flange 9 provides a stabilizing of the container sides which is sufficient to use the container even without a lining and so that it may be provided with a recloseable separate lid, and in this case the edge flange directed outwards and downwards serves to keep said lid attached to the container by the stretching action thereof.

Figure 5:
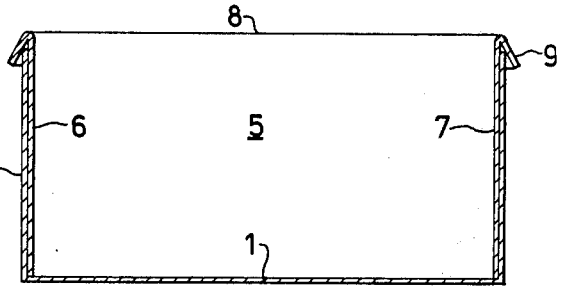
FIG. 5 is a cross section along line V—V of FIG. 2.
Figure 6:
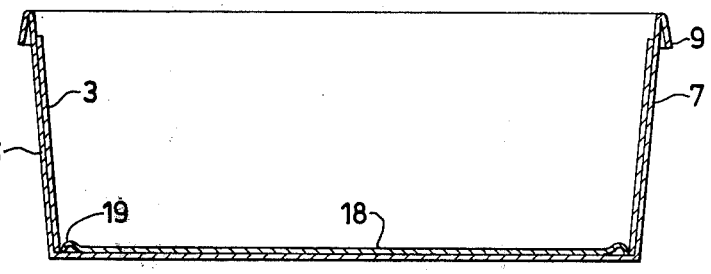
FIG. 6 shows a cross section through a conical container having rectangular bottom section.

In FIG. 6 is shown a somewhat modified embodiment of the container according to FIG. 1, 2 and 5, which differs from the above described embodiment in that it diverges in the direction upwards, and in that the joint flaps 3 are glued to the outer side parts 6 and 7 at the inside of the container bowl.

Figure 3:
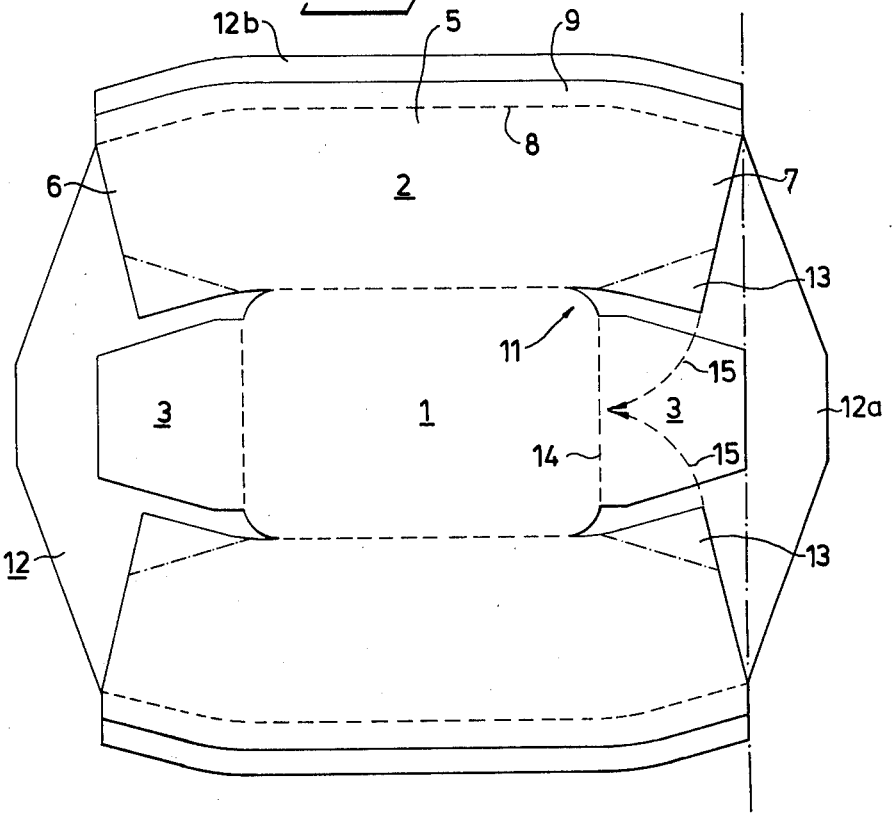

In FIG. 3 is shown a blank for a cup formed container which is formed diverging in the direction upwards and which has rounded corners 11 both at the bottom and at the upper edge. In order to provide the rounded corners the bottom corners are free both from the side pieces 2 and the joint flaps 3, and so as to provide the cone form of the container the outer side parts 6 and 7 respectively are turned in relation to the central side part 5. Both along the central side part 5 and the turned outer side parts 6 and 7 extends an edge strip 9 which forms the edge flange extending downwards at an angle to the container sides in the ready container.

The container blank according to FIG. 3, which is shown from underneath, is combined with a lining blank 12, which to its form corresponds to the cardboard container blank but which with a part **12*a* extends outside the joint flaps 3 and across the slot between the joint flaps 3 and the adjacent outer side part 6 and 7 respectively. Suitably the lining blank also extends with a narrow strip 12*b* outside the edge strip 9 of the cardboard blank, so that the lining blank with the strip 12*b* thereof may be folded in under the cardboard container strip 9. The lining blank 9 may consist of paper, waxed paper, parchment, a thin metal foil or any other thin and easily foldable combined material like a thin metal foil covered with paper or similar material. The lining blank may be glued or laminated over the main part of the cardboard container blank, but in order to facilitate the erection and the joining of the container preferably a little part of the lower corners 13 of the outer side parts 6 and 7 are left unglued, so that the said corners 13 may when erecting the container without being prevented by the lining blank 12 be brought to a position edge to edge against each other at the bottom edge 14 as indicated with the dotted arrows 15**.

Figure 4:
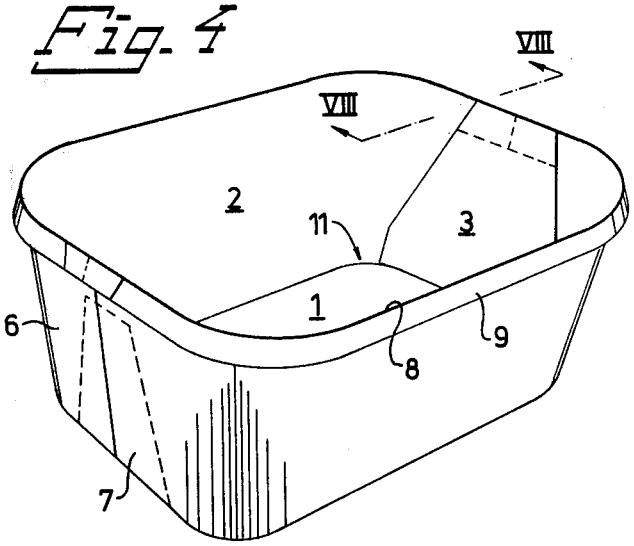

If the joint flaps 3 are to be provided at the inside of the container as indicated in FIG. 4 the lining is glued or laminated also to the joint flaps, but in case the joint flaps 3 are to be provided at the outside of the container as indicated with the dotted lines in the left hand part of FIG. 4 the lining blank is left free also from the joint flaps 3. In some cases it may show that the lining blank is subjected to such stresses when folding the edge strips 9 that it tends to burst, and in such cases it may be advantageous to leave the lining blank unglued to the edge flange part 9.

The erection of the container blank shown in FIG. 1 does not offer any difficulties at all. The edge strips 9 are first folded down over the outer side of the side pieces 2, whereupon said side pieces are folded up, the outer side pieces 6 and 7 are folded in, and finally the joint flaps 3 are glued to the outer side parts 6 and 7 so that the container thereby forms a unit which is well kept together.

The erection of a conical container blank must however take place so that the edge strips 9 are folded outwards in a direction towards the intended outside of the side pieces 2 at the same time as the side pieces are folded up and the outer side pieces 6 and 7 are folded in toward each other. In case the container blank has a lining foil as shown in FIG. 3 the overhanging lining blank strip **12*b* is before or after the erection of the container fold in under the edge flange 9 of the cardboard container and is glued to the inside thereof so as to form an attractive and water or fat repellent surface of the edge flange 9. The overhanging lining blank part 12*a* is in turn fold in between the joint flaps 3 and the outer side parts 6 and 7 so that they are completely hidden there-between. The outer side parts 6 and 7** are then glued to the joint flaps 3, and the outermost part of the overhanging lining 12*a* is finally fold in under the edge flange 9. In case the joint flaps 3 are provided at the outside of the container the fold lining blank is glued to the inside of the outer side parts 6 and 7, whereas the joint flaps 3 are glued directly to the outside of the outer side parts 6 and 7.

In order to save material the cardboard material is preferably punched so that the edges of the edge strips 9 and the edge of the joint flaps 3 turned from the bottom are located on the same line as indicated with the phantom line at the right hand side of FIG. 3.

Figure 7:
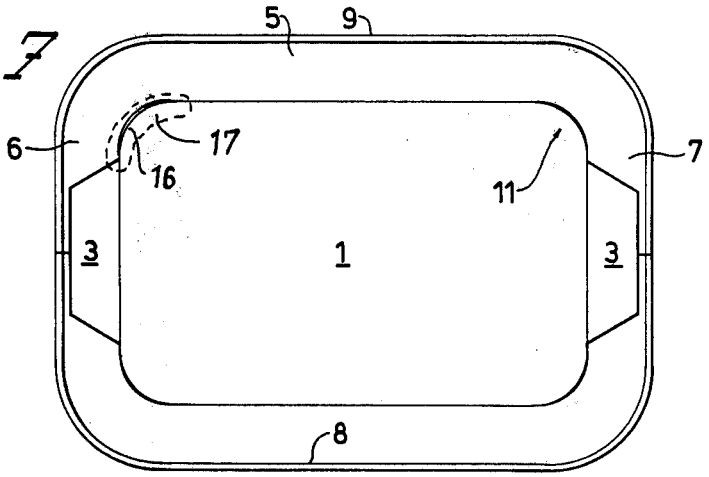
FIG. 7 is an unlined container of the type shown in FIGS. 3 and 4 seen from above.
Figure 8:
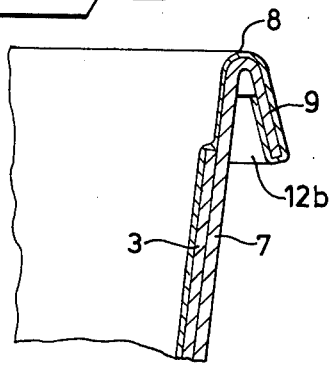
FIG. 8 is cross section along line VIII—VIII of FIG. 4 showing a little part of the upper edge of a container.

In FIG. 7 a cardboard container is shown from above which substantially corresponds to the container according to FIG. 4, but which has no lining foil. Somewhat exaggerated it is shown in FIG. 7 how a narrow slot 16 may come up between the bottom corner 11 and the adjacent parts of the side pieces 2 and in case the container is to be used for liquids or semi-liquid products the said slots 16 are sealed by applying wax or similar material at the corners as indicated with the dotted lines A of FIG. 7 or by applying a thin layer of wax or similar material over the complete bottom 1 and against the side pieces 2, or by providing the container with a separate sealing bottom 18 as shown in FIG. 6. The said separate bottom 18 may be made of cardboard or any other suitable material and it is formed with an upwards bent rim 19 which is glued to the container sides 2.

Figure 10:
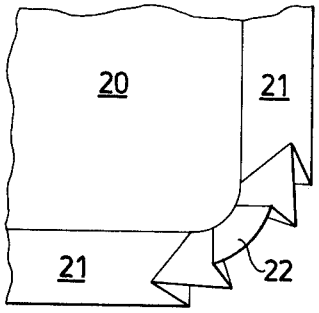
FIG. 10 shows a little part of a corner of the lining according to FIG. 9 during a stage of the formation thereof.
Figure 9:
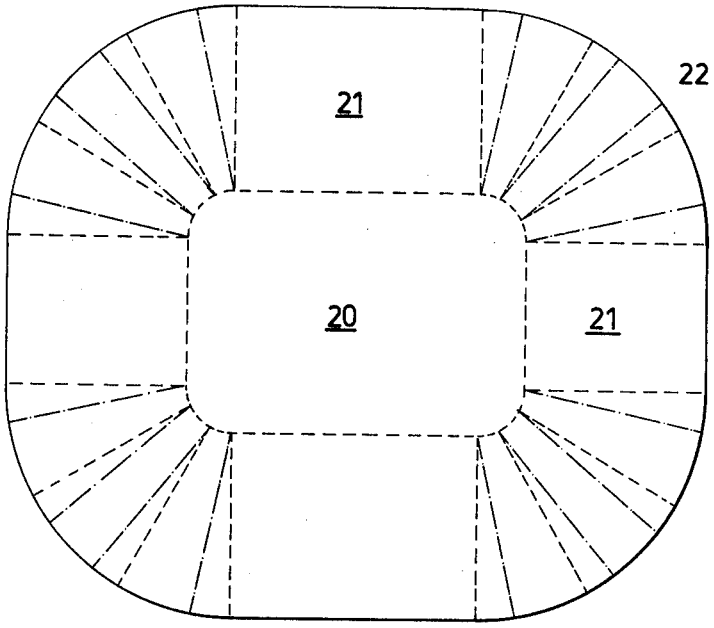
FIG. 9 shows one embodiment of a blank for a separate lining which may be used in combination with the container according to FIG. 7.

The container may also be provided with a separate lining of paper, thin metal foil or similar, and one example of such a lining which may be used for the container according to FIG. 7 is shown in FIGS. 9 and 10. The lining has a bottom 20, four side pieces 21 and between the said side pieces a number of corner fold pieces 22. In FIG. 10 is diagrammatically shown one example of a corner fold of the lining at a stage of the erecting of the lining. The corner folding can take place at the same time as the lining is pressed down into the container cup, and after the lining is pressed down the overhanging edges thereof are likewise fold in under the edge flange 9 of the outer container cup.

In the above described embodiments of the invention the joint flaps are with their side edges separated from the corresponding parts of the side pieces in order to facilitate the joining of the container and to give the container a smooth outside since the container is no place composed by more than two layers of cardboard material.

In lined containers such embodiments may however provide certain problems in that the lining cannot be glued or laminated over the complete cardboard container blank, but some parts have to the excluded from such glueing or laminating in order to make the joining possible.

Figure 11:
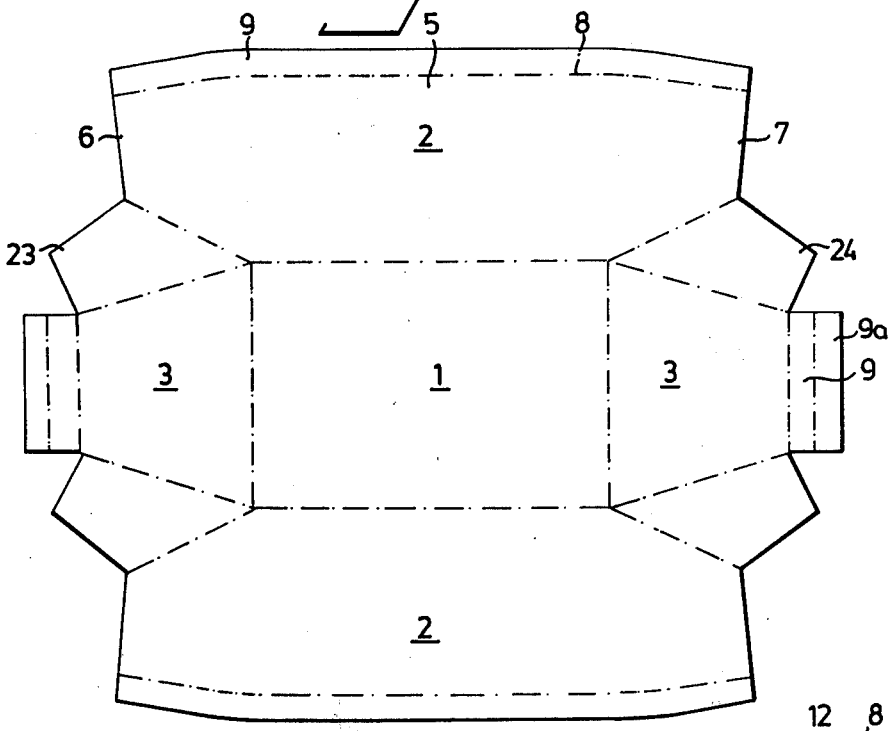
FIG. 11 shows a plain punched and creased blank for a modified container according to the invention.
Figure 13:
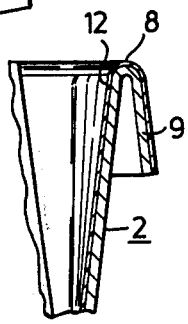
FIG. 12 shows a ready container in a perspective view and FIG. 13 shows a little part of the container see along line 13—13 of FIG. 12.
Figure 12:
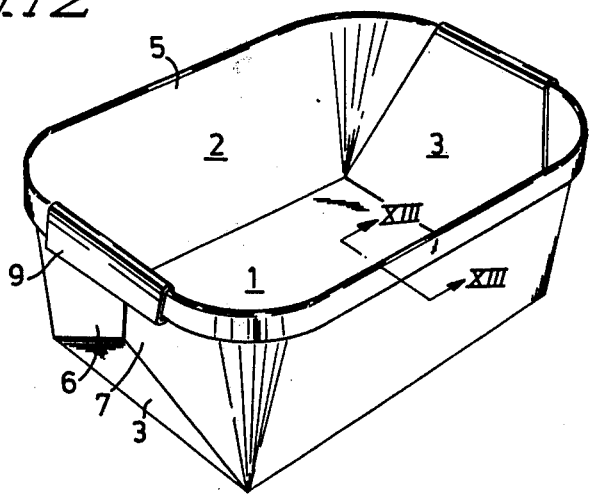

In the embodiment of the invention shown in FIGS. 11–13 the lining material 12 is glued over the complete surface of the outer container blank and is of the same form and size as the outer container blank. The container blank is also in this case formed with a bottom 1 of rectangular form, two opposite side pieces 2 which are coherent with the bottom and two opposite joint flaps 3 which are likewise coherent with the said bottom. The side pieces 2 are wider than the side of the bottom with which they hang together, and each side piece 2 forms a central side part 5 and on each side thereof an outer side part 6 and 7 respectively. The outer side parts 6 and 7 are over corner fold pieces 23 and 24 coherent with the joint flaps 3. Along the outer edges of the side pieces 2 and the joint flaps 3 edge strips 9 extend, which are intended to form the downwards directed flange extending round the container cup. The bottom 1, the side pieces 2, the joint flaps 3 and the corner fold pieces 23 and 24 provide a coherent unit the different parts of which are provided by creasing lines. The edge strips 9 are further formed by creasing lines 8 which provides the upper edge of the container.

The erection of the container according to FIGS. 11–13 takes place so that the joint flaps 3 are fold up closely followed by the side pieces 2, whereas the joint flaps 23 and 24 are folded in between the joint flaps 3 and the outer side parts 6 and 7 respectively. During the beginning erection of the container also the edge strips 9 of the side pieces 2 are fold outwards-downwards, and after the corner fold pieces 23 and 24 and the outer side parts 6 and 7 have been attached to the joint flaps 3 the edge strips 9 of the joint flaps 3 are finally fold downwards and are attached to the edge strips of the outer side parts 6 and 7. In this embodiment of the invention the edge strips 9 of the joint flaps 3 are wider than the edge strips of the side pieces, and the aim herefore is that the outer part 9*a* of the said edge strips should be fold in under the edge strips of the side pieces and be attached in this position. Alternatively the edge strips of the joint flaps 3 may be made the same width as the edge strips of the side pieces and may be attached to the outside of the latter ones.

The attaching of the corner fold pieces and the outer side parts to the joint flaps preferably takes place by point glueing, welding or in any other previously known way.

By forming a container of the above described kind with a narrow flange directed downwards at an angle to the container sides and by glueing the joint flaps 3 to the corresponding outer side parts of the side pieces 2 a stable and firm container is obtained without using any special stiffening means, even without increasing the volume weight of the cardboard material. Since there is no need of using a lining of plastic material the container may in addition to the advantages involved in a non-use of plastic material be manufactured to a lower cost than previously, and it may alternatively be formed completely unlined with small sealing points at the corners or with the container blank provided with a thin and easily foldable lining foil. Except for stiffening the container the edge flange serves the purpose of forming a spill edge and to remove such edge cuts which should not be exposed to the content of the container. In containers having a thin lining foil overhanging parts of the lining may be put in under the edge flange and contribute to a further stiffening of the container at the same time as giving the container an attractive appearance. Since the container may be formed of a relatively thin cardboard material thanks to the edge flange it does not involve any essential disadvantages that parts of the container are composed by several layers of cardboard material like the free layers at the corner fold pieces 23 and 24 in the embodiment according to FIGS. 11–13. This is of importance since it is of importance to be able to provide the container blank as a continuous piece of material in which the lining material is laminated over the entire outer container blank.

It is to be understood, that the above described and shown embodiments of the invention are only of examplifying nature and that all kinds of modifications may be presented within the scope of the appended claims.

I claim:

1. Cup formed container made of a plain punched container blank of cardboard or similar stiff material and comprising a bottom (1), two opposite side pieces (2) which are coherent with the said bottom, and which are wider than the side of the bottom (1) with which they are connected, and two opposite joint flaps (3) which are of the same or less width than the side of the bottom (1) with which they are connected, characterized in that each side piece (2) with a central side part (5) forms a complete container side and with an outer side part (6,7) on each side of said central side part (5) forms part of an adjacent container side, so that the outer side parts (6,7) of the two side pieces (2) jointly form at least partially the intermediate container sides, whereby the joint flaps (3) serve to complete the said intermediate container sides and keep the parts thereof together, and that the container round the complete upper edge, including the corners, is formed with a downwards directed narrow edge flange, which is made of and folded from the same piece of material as the container sides and which forms an angle to the container sides, said flange being continuous and unbroken along said central side parts and said outer side parts of said side pieces, and hence around the corners of the container upper edge.

2. Cup formed container according to claim 1, characterized in that the inner side of the container cup contains a thin and easily formable lining, which lining with an overhanging part is folded round the edge flange (9) and is folded in between the said edge flange (9) and the container sides.

3. Cup formed container according to claim 1, characterized in that the container cup is unlined, and that the container cup at its inner corners is provided with a little amount of a sealing material (17).

4. Cup formed container according to claim 1, characterized in that the container is unlined and that the interior of the container at its bottom is provided with a bottom plate (18) of a sealing material which is glued to the container sides.

5. Cup formed container according to claim 4, characterized in that the bottom plate (18) is formed with laterally folded edges (19) by means of which the plate is attached to the container sides.

6. Cup formed container according to claim 1, characterized in that the container is divergent upwards, whereby the outer side parts (6,7) of the plain punched container blank are angled relative to their connected central side part (5), and that a narrow continuous outer edge strip (9) is delimited by a creasing line (8) along each central side part (5) and the two outer side parts (6,7).

7. Cup formed container according to claim 6 characterized in that the container has arched bottom corners (11), and that said corners (11) are separated from the side pieces (2) and the joint flaps (3), and that a thin and easily formable lining foil (12) is glued over the main part of the cardboard blank for the container.

8. Cup formed container according to claim 7, characterized in that the lining foil (12) on the container blank extends some distance outside the joint flaps (3) and over the slots between the joint flaps (3), the arched container corners (11) and the adjacent parts (6,7) of the side pieces.

9. Cup formed container according to claim 8, characterized in that on the container blank the lining foil (12) with narrow strip (12*b*) projects outside each strip (9) along the outer edges of the side pieces (2), whereas the lining foil extends edge to edge with the short edges of the said edge strips (9).

10. Cup formed container according to claim 9, characterized in that the lining foil (12) is glued to substantially the entire container blank except for a triangular part (13) at the lower corners of the outer side parts (6,7).

11. Cup formed container according to claim 7, characterized in that the joint flaps (3) are left unglued and that they are provided at the outside of the outer side parts (6,7).

12. Cup formed container according to claim 8, characterized in that the part (12*a*) of the lining foil projecting outside the joint flaps (3) extends to a line (8) corresponding to the upper edge of the ready container.

13. Cup formed container according to claim 1, characterized in that the joint flaps (3) are coherent with the outer side parts (6, 7) over corner fold pieces (23, 24), so that the container blank is formed by a continuous piece of material, and in that the container blank at the intended inside thereof has a lining material (12) which is laminated or glued over the entire cardboard blank and which is of the same shape and size as the cardboard blank.

14. Cup formed container according to claim 13, characterized in that both the side pieces (2) and the joint flaps (3) of the blank are formed with edge strips (9) for forming the downwards slanting narrow edge flange of the ready container, and that the edge strips (9) of the joint flaps are attached to the outside of the edge strips (9) of the outer side parts (6, 7) in the completed container.

15. Cup formed container according to claim 14, characterized in that the edge strips (9, 9*a*) of the joint flaps (3) are wider than the edge strips (9) of the side pieces (2), and that the outer parts (9*a*) of the joint flap edge strips are folded in and up behind the edge strips (9) of the side pieces (2).

* * * * *